US005628878A

United States Patent [19]

Cutshall et al.

[11] Patent Number: 5,628,878

[45] Date of Patent: May 13, 1997

[54] METHOD OF REDUCING AIRBURNING IN PETROLEUM COKE

[75] Inventors: Euel R. Cutshall, Tuscumbia; Nolan E. Richards, Florence, both of Ala.

[73] Assignee: Reynolds Metals Company, Richmond, Va.

[21] Appl. No.: 241,542

[22] Filed: May 12, 1994

[51] Int. Cl.[6] ..... C10B 39/04; C10B 57/06

[52] U.S. Cl. ..... 201/39; 201/41; 204/290 R; 205/384

[58] Field of Search ..... 201/41, 17, 39; 202/227, 253, 95; 204/290 R; 106/286.5, 286.8, 287.17; 44/607; 205/384

[56] References Cited

U.S. PATENT DOCUMENTS

| | | | |
|---|---|---|---|
| 3,798,024 | 3/1974 | Murphy et al. | 75/672 |
| 3,951,763 | 4/1976 | Sleppy et al. | 204/67 |
| 3,959,084 | 5/1976 | Price | 201/39 |
| 4,259,175 | 3/1981 | McArthur | 208/113 |
| 4,308,114 | 12/1981 | Das et al. | 204/67 |
| 4,340,426 | 7/1982 | Tabei et al. | 75/309 |
| 4,428,847 | 1/1984 | Boxall et al. | 204/294 |
| 4,469,557 | 9/1984 | Schweer et al. | 201/17 |
| 4,529,483 | 7/1985 | Jung | 201/39 |
| 4,592,813 | 6/1986 | Henry | 204/245 |
| 4,718,984 | 1/1988 | McConaghy, Jr. et al. | 202/99 |
| 4,875,979 | 10/1989 | Drac et al. | 201/17 |

FOREIGN PATENT DOCUMENTS

| | | |
|---|---|---|
| 0006213 | 1/1978 | Japan . |
| 137412 | 10/1979 | Japan . |
| 190876 | 11/1983 | Japan . |
| 261802 | 11/1987 | Japan . |
| 6418558 | 1/1989 | Japan . |
| 1113428 | 9/1984 | U.S.S.R. . |

OTHER PUBLICATIONS

CAS 1985: 547793.
CAS 1977. 521870.

*Primary Examiner*—Virginia Manoharan
*Attorney, Agent, or Firm*—Alan T. McDonald

[57] ABSTRACT

A method of reducing the airburning tendency of petroleum coke and carbon anodes made therefrom includes calcining the coke and spray quenching the calcined coke with an additive-containing water. The additive includes an effective amount of a compound of aluminum which is soluble in the quench water. The additive is deposited on the quenched coke product surface and protects the coke from oxidation or premature combustion when in contact with the atmosphere at high temperatures. The additive-coated coke can then be formed into an anode which also has a reduced tendency to airburn during use in a high temperature environment such as an aluminum reduction cell or an electric furnace operation.

7 Claims, 1 Drawing Sheet

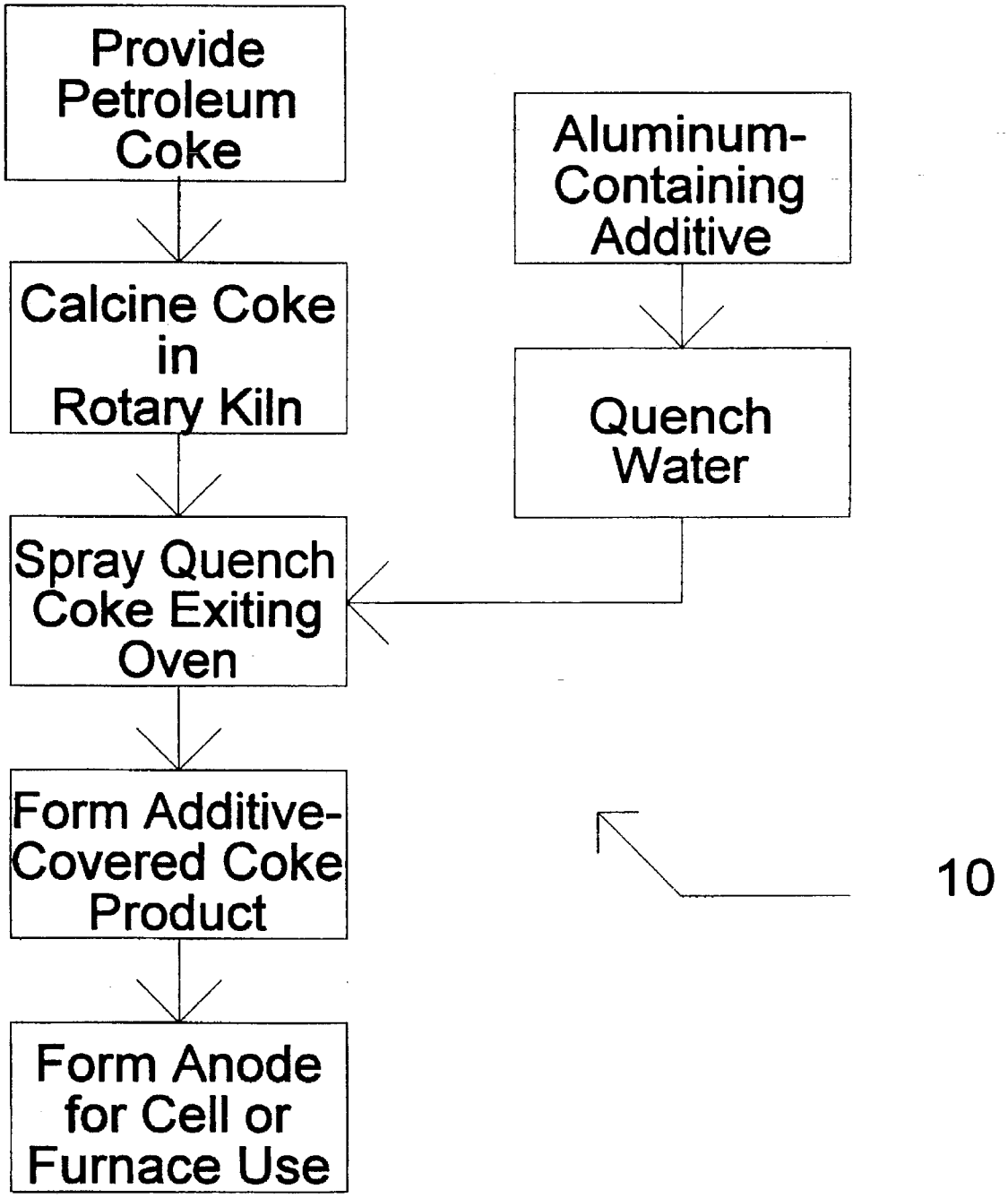
Provide Petroleum Coke
Calcine Coke in Rotary Kiln
Spray Quench Coke Exiting Oven
Form Additive-Covered Coke Product
Form Anode for Cell or Furnace Use
Aluminum-Containing Additive
Quench Water
10

METHOD OF REDUCING AIRBURNING IN PETROLEUM COKE

FIELD OF THE INVENTION

The present invention is directed to a method of reducing airburning in petroleum coke and, in particular, quenching the petroleum coke after calcining thereof with water containing an additive of aluminum in soluble form.

BACKGROUND ART

The manufacture of petroleum coke for anode production, particularly for the manufacture of aluminum, is well known. U.S. Pat. No. 4,718,984 to McConaghy, Jr. et al. describes the prior art process of calcining petroleum coke at high temperatures to drive off volatile hydrocarbons and moisture. The calcined product may then be used to produce anodes for aluminum manufacture and, in cases where the coke is of a premium quality, it can be used for manufacture of graphite electrodes useful in electric arc steelmaking processes.

The petroleum coke is generally calcined at temperatures between 1250° and 1400° C. to reduce its volatile content and establish electrical conductivity. Calcination generally takes place in a rotary kiln. Upon exiting the kiln, the hot coke is usually cooled with a water spray to avoid unnecessary reaction of the carbon with oxygen in the air as shown in the following reaction:

$$C+O_2 \rightarrow CO_2.$$

Alternatively, coke quenching can be performed using other quenching media such as water baths, steam, inert gases or a combination thereof.

The quenched coke is then manufactured into anodes as is well known in the prior art.

One of the problems inherent in the manufacture of coke product is burning or combustion thereof when the coke is exposed to air after being subjected to high temperatures. Because of this airburning tendency, the coke product is quenched or cooled to below its ignition temperature.

U.S. Pat. No. 3,959,084 to Price recognizes this problem and proposes a two step cooling process using both inert gases and water quenching.

A similar airburning problem exists when the coke is formed into anodes, especially for aluminum production. Since these anodes operate in aluminum reduction cells at temperatures approximating 950° C., the anodes can be consumed by oxygen in the air if not properly covered.

In aluminum reduction cells, the anode is covered by an electrolytic bath typically including alumina and cryolite. This covering material not only provides a source of aluminum for the reduction cell but also protects the anode against premature oxidation or airburning. However, the electrolytic bath may not always cover the anode and protect it from airburning. Exposure of the anode to air in the high temperature environment of the aluminum reduction cell can adversely affect the production of aluminum as well as anode life.

In view of the problems associated with maintaining a cover on the anode of an aluminum reduction cell, a need has developed to find alternative ways to reduce or prevent the airburning of anodes in these types of high temperature manufacturing processes.

In response to this need, the present invention provides a method of treating the petroleum coke used in making these types of anodes which minimizes the exposure of the anode to air regardless of the presence of a protective covering.

SUMMARY OF THE INVENTION

Accordingly, it is a first object of the present invention to provide a method of reducing or preventing airburning of anodes manufactured from petroleum coke.

Another object of the present invention is to provide a method of reducing the airburning tendency of anodes, especially in aluminum manufacture, independent of the presence of a covering material.

A further object of the present invention includes providing a petroleum coke product which contains an effective amount of an additive on the surface thereof which reduces the coke product's tendency towards airburning, especially when formed into an anode.

Other objects and advantages of the present invention will become apparent as a description thereof proceeds.

In satisfaction of the foregoing objects and advantages, the present invention is an improvement in the method of making petroleum coke for use in manufacturing anodes wherein the coke is calcined at high temperatures and quenched in water. According to the invention, the step of quenching of the high temperature calcined coke includes applying quenching water containing an effective amount of aluminum as an additive in a water soluble form. The additive is then deposited on the surface of the coke during the quenching step to reduce the airburning tendency of the quenched coke and anodes manufactured therefrom.

Preferably, the additive is aluminum fluoride and the quench water pH is controlled between 10 and 12. When using aluminum fluoride as the additive, a preferred concentration in the quench water is 0.01 g/l to 8.0 g/l. The quench water is preferably sprayed on the hot coke exiting the rotary kiln.

BRIEF DESCRIPTION OF THE DRAWINGS

Reference is now made to the sole figure which shows a schematic block diagram depicting the method of the present invention.

DESCRIPTION OF THE PREFERRED EMBODIMENTS

The present invention solves the problem of airburning of carbon anodes manufactured from petroleum coke in high temperature environments. In the aluminum industry, these anodes have a tendency to airburn if a covering material does not sufficiently protect the anode from exposure to the atmosphere.

According to the invention, the petroleum coke is treated with an additive during quenching thereof and prior to anode manufacture. The additive in the quenching water is deposited on the surface of the coke to an extent that airburning is prevented or reduced when the coke is manufactured into an anode and subjected to high temperatures.

The present invention provides aluminum as an additive in soluble form to the quench water used to cool the petroleum coke when processed for anode manufacture.

In processing petroleum coke for anodes, the coke is typically calcined at high temperatures, e.g. 1250° to 1400° C., followed by quenching using an inert gas, steam, water sprays, a quench bath or the like.

In its broadest embodiment, the invention provides an additive to the quench water prior to the quenching step. The additive is then deposited on the surface of the quenched coke, the deposited additive providing an effective covering or coating which reduces airburning of the coke when it is formed in an anode and subjected to high temperatures.

The additive contains aluminum in a form that is soluble in the quench water. The additive is added to the quench water in an amount that is effective to coat the coke particles sufficiently to prevent or reduce subsequent airburning thereof. An "effective amount" is considered to be a minimum amount which, when deposited on the coke surface, reduces or prevents airburning up to an amount corresponding to the solubility limit of the soluble form of aluminum in water.

In a preferred embodiment, aluminum fluoride is added to the quench water in an effective amount as described above. Preferably, the aluminum fluoride concentration ranges between 0.1 g/l to 8.0 g/l. Optimally, the quench water is maintained with a pH between 7–14 and, more preferably, between 10 and 12. The aluminum fluoride concentration is more preferably 4.0 to 6.0 g/l and optimally about 5.0 g/l.

By dissolving the aluminum fluoride in water at a pH of 10 to 12 and spraying the aluminum-containing solution on the coke being quenched, the aluminum compounds can be directly deposited onto the high surface area coke and significantly reduce its airburning tendency. Deposition is believed to occur when the aluminum and fluorine ions present in the quench water recombine at the coke surface when the quench water evaporates from the heat in the calcined coke. Besides reducing the airburning tendency of the quenched coke, the airburning tendency of the aluminum reduction cell anodes produced using this coke is also reduced.

With reference to the sole figure, the inventive method of reducing the airburning tendency of petroleum coke is generally designated by the reference numeral 10. In a first step, petroleum coke is provided from any conventional source.

The petroleum coke is calcined in a rotary kiln followed by spray quenching the coke exiting the kiln. The quench water used for the spraying step includes an aluminum containing additive in solution in the quench water. The additive may be dissolved in the quench water in any known manner including mixing the additive as a powder into the quench water, either in a batch or continuous mode. For example, a quantity of aluminum fluoride powder can be metered into the quench water to achieve the desired concentration to provide an effective amount of additive for spray quenching the coke. Any known control system can be used to monitor and regulate the additive concentration.

The spray quenching step forms an additive-covered coke product which can be subsequently formed into an anode for reduction cell or furnace use.

Although aluminum fluoride is disclosed as a preferred additive for the high temperature calcine coke quenching spray, any water soluble additive containing aluminum can be utilized. Moreover, any known method or apparatus can be used to calcine the petroleum coke prior to quenching. In addition, the additive may be used in a water bath or with water in combination with other known quenching media.

Laboratory testing has been performed using aluminum fluoride as the water soluble aluminum-containing additive for quenching coke. This laboratory testing has demonstrated that the aluminum fluoride is deposited on the quenched coke surface as an effective deterrent to airburning of coke and the anode produced therefrom.

As such, an invention has been disclosed in terms of preferred embodiments thereof which fulfills each and everyone of the objects of the present invention as set forth hereinabove and provides a method of reducing the airburning tendency of petroleum coke and anodes manufactured therefrom as well as products made by the inventive method.

Various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. In a method of making petroleum coke for use in manufacturing anodes wherein coke is calcined to provide a calcined coke and quenched in water, the improvement comprising the steps of quenching said calcined coke by applying water on the calcine coke to provide a quenched coke, said water containing an mount of aluminum fluoride ranging between 0.1 and 8.0 g/l as an additive in a water soluble form, depositing said additive on the surface of said quenched coke prior to said quenched coke being formed into an anode to reduce airburning of said quenched coke and anode subsequently manufactured from said quenched coke and forming said quenched coke into an anode for use in a high temperature environment wherein said anode has a coating of said additive.

2. The method of claim 1 wherein said coke is calcined in a rotary kiln and the calcined coke is sprayed with said additive-containing water when exiting said rotary kiln.

3. The method of claim 1 wherein the pH of said applied water is controlled between 7 and 14.

4. The method of claim 3 wherein said pH is controlled between 10 and 12.

5. The method of claim 4 wherein said aluminum fluoride-containing water is sprayed on said calcined coke.

6. The method of claim 1 wherein said additive ranges between 4.0 and 6.0 g/l.

7. The method of claim 1 wherein said anode is used in an aluminum reduction cell for manufacture of aluminum.

* * * * *